United States Patent [19]

Brücher et al.

[11] 4,057,234

[45] Nov. 8, 1977

[54] TAPHOLE BORING OR PLUGGING MACHINE FOR SHAFT FURNACES, ESPECIALLY BLAST FURNACES

[75] Inventors: Eberhard Brücher, Siegen-Weidenau; Karl-Heinz Schüssler, Siegen, both of Germany

[73] Assignee: Dango & Dienenthal, Siegen, Germany

[21] Appl. No.: 617,775

[22] Filed: Sept. 29, 1975

[30] Foreign Application Priority Data

Mar. 6, 1975 Germany ..... 2509805

[51] Int. Cl.[2] ..... C21B 7/12

[52] U.S. Cl. ..... 266/272; 266/271; 408/236

[58] Field of Search ..... 266/271, 272; 408/712, 408/129, 236

[56] References Cited

U.S. PATENT DOCUMENTS

| | | | |
|---|---|---|---|
| 3,121,769 | 2/1964 | Horn | 266/271 X |
| 3,190,629 | 6/1965 | Draper | 266/271 X |
| 3,376,030 | 4/1968 | Adams | 266/271 X |
| 3,667,748 | 6/1972 | Dienenthal et al. | 266/271 X |
| 3,700,347 | 10/1972 | Nanne et al. | 266/271 X |

*Primary Examiner*—Francis S. Husar
*Assistant Examiner*—Gus T. Hampilos
*Attorney, Agent, or Firm*—Lawrence I. Field

[57] ABSTRACT

A taphole boring or plugging machine having a simple and compact design affording rotation of the tool arm in several planes is provided which comprises: a pivotably supported connection at the free end of the machine tool arm and with a universal joint supported therein, and support bracket which is pivotably supported by the horizontal axle of the universal joint.

2 Claims, 6 Drawing Figures

TAPHOLE BORING OR PLUGGING MACHINE FOR SHAFT FURNACES, ESPECIALLY BLAST FURNACES

The invention relates to a taphole boring or plugging machine for shaft furnaces, especially blast furnaces, comprising a machine tool arm pivoting about a horizontal axis of a console and a support console at the free end of said arm, pivoting about a horizontal axle which is normal to the axis of rotation of the machine tool arm. The support console supports a carriage holding the taphole boring tool or for a plugging gun.

The taphole boring machine known from German Pat. No. 1,243,219 makes use of pivotable support of the machine tool arm primarily to rotate the arm from its approximately horizontal operation position into its rest position and vice-versa. When in the operating position, the position of the machine tool arm may be adjusted by adjusting screws or bolts to set the carriage at the desired height above the mill floor. The machine tool arm therefore may be pivoted a limited amount about its horizontal axis within its operating positions, so that as a rule only tapholes may be bored which are approximately the same height above the floor. Tapholes in conventional blast furnaces are usually bored at an angle of 15° to 20° to the horizontal. The carriage may be adjused in a vertical plane for the particular desired bore angle with respect to the horizontal. For this purpose, the carriage is pivotably supported by a frame at the free end of the machine tool arm. The angle of rotation is large enough for the carriage to be moved together with the boring tool into an upper pivoting position in which the boring tool runs approximately horizontally, so that in theory, horizontal tapholes might also be bored. However, the pivoting motion of the machine tool arm prevents boring several tapholes one above the other. Furthermore, the known taphole boring machine is fairly high, so that it cannot be mounted underneath a low mold or form platform* as are present in modern, large blast furnaces.

*furnace platform or working platform in the region of the tuyeres (translator)

German Patent 1,231,272 describes a taphole boring machine in which a yoke supporting the carriage may pivot in a horizontal plane about a vertical axis at the free end of the machine tool arm. The boring tool therefore may be set at different angles in the horizontal. Furthermore, a bore tool carriage carrying a dual tool may be set at an arbitrary inclination with respect to the horizontal by means of spindles in the support bar and the bore tool carriage and the support bar may be displaced laterally in parallel to the furnace taphole. This displacement is merely for the purpose of bringing the entire equipment into the rest position. In another embodiment of this taphole boring machine, the rest position is reached essentially by the support bar being seated in a punch moving to and fro in an essentially vertical pipe. Hence, the support bar may be elevated to a great height with respect to the taphole; however this is not the operating position.

U.S. Pat. No. 3,121,769 discloses a taphole boring machine in which the machine tool arm may pivot about the vertical axis of a bracket into its operating and rest positions.

Each of these and other known taphole boring machines suffer from the drawback that their height is excessive and therefore the machine will not fit underneath the low forming stages such as are conventional in new large blast furnaces, and that furthermore the prior art taphole boring machines may execute only certain limited motions, not all of which are required in present day operations in a modern blast furnace operation. As modern blast furnaces increase in size, such high pressure is present at the throat or top that the taphole can only be bored horizontally in order to avoid the pig iron flow from gushing out of the taphole in a large arc on account of the high furnace pressure. Such high pressure furnaces furthermore require the tapholes at different elevations. In addition it is absolutely necessary to provide an emergency taphole, which ordinarily will be located appreciably higher than the ordinary taphole and frequently closely underneath the forming stage. These most varied tasks can only be carried out separately with the heretofore known taphole boring machines.

The present invention therefore is directed to providing a taphole boring or plugging machine for shaft furnaces and especially blast furnaces and particularly those which operate under high pressures, by means of which tapholes may be bored and sealed at various heights of a shaft furnace and at various angles. This problem is solved by the present invention in that the support console together with the carriage and/or the plugging gun may be additionally tilted about a vertical axis with respect to the machine tool arm and in that the carriage and/or the plugging gun may be tilted with respect to the support console about an axis parallel to that of rotation of the machine tool arm. Contrasted to the known taphole boring machines, the taphole boring machine of the present invention will completely meet all requirements. Thus, by means of the taphole boring machine of the present invention, tapholes may be bored which are located at different elevations in a single vertical plane and they may be bored horizontally or at a slant. In contrast to the known taphole boring machines, the taphole boring machine of the present invention therefore is of universal application.

Advantageously the taphole boring machine of the invention is provided with a pivotably supported connection at the free end of the machine tool arm and with a universal joint supported therein and pivoting about a vertical axis, the support bracket being pivotably supported by the horizontal axle of said universal joint, whereby a simple and compact design affording rotation of the tool arm in several planes is provided.

The invention will be better understood from the description of a preferred embodiment of the invention which follows and from the drawings in which.

Figure 3:
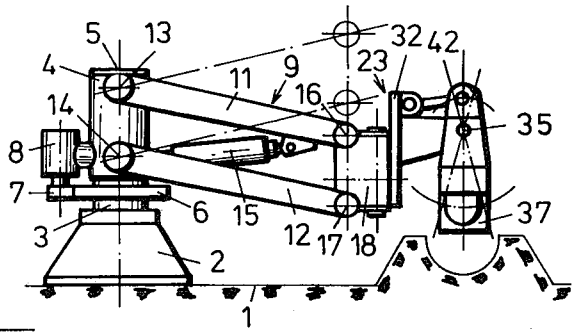
FIG. 3 is a side view of the machine.

A console 2 mounted on the mill floor 1 is provided with a vertical column 3 on which a shell 4 may pivot about a vertical axis. Shell 4 connected to a gear ring 6 for the pivoting drive, said ring being connected to a pinion 7 which in turn is driven by a drive motor 8.

A machine tool arm 9 comprising a pair of support levers 11, 12 is linked to shell 4. These support levers 11, 12 are pivotably supported on shell 4 to rotate in the manner of a parallelogram about bearing axles 13, 14 and may be lowered or raised by means of a lifting cylinder 15 acting on them, for instance they may be elevated into the position shown in dash-dot lines in FIG. 3. A connection piece 18 is pivotably supported by bearing axles 16, 17 at the other ends of support levers 11, 12 so that upon pivoting up the levers 11 and 12, the connection piece 18 will always retain its horizontal orientation.

Figure 6:
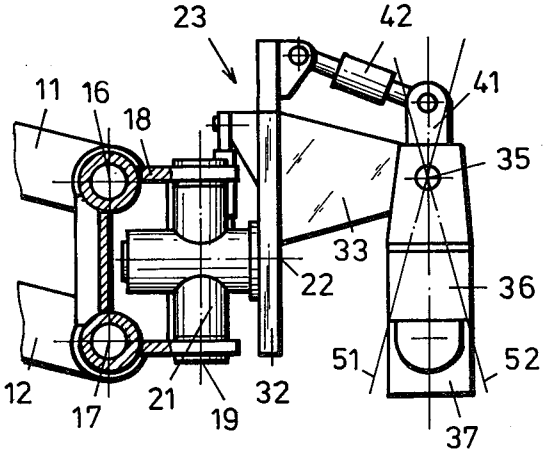
FIG. 6 is a view, partly in section, taken along line VI—VI of FIG. 5.
Figure 5:
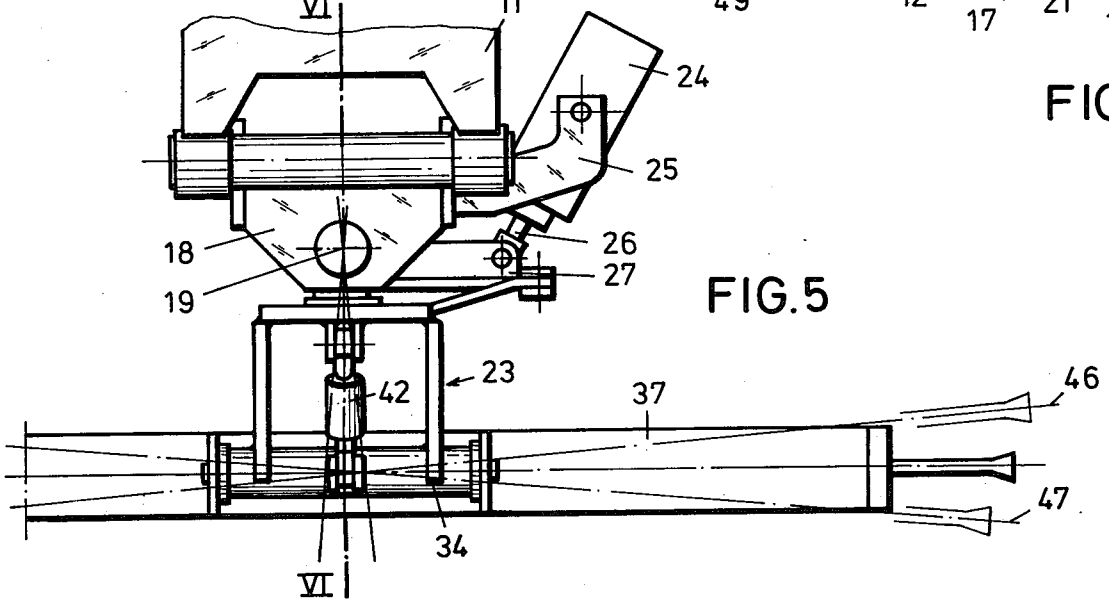
FIG. 5 is the top view on the front part of the machine tool arm.

As seen best in FIG. 6, a universal joint 21 is pivotably supported about a vertical axle 19. A console 23 is pivotably supported about the horizontal axle 22 of universal joint 21. A displacement cylinder 24 (FIG. 5) is used to pivot console 23 about vertical axle 19 of said universal joint; said cylinder is pivotably supported by an arm 25 mounted to the connection piece 18 and furthermore is hingeably connected by its piston rod 26 to an arm 27 which in turn is fixedly connected to vertical axle 19. Therefore, console 23 may be rotated about vertical axle 19 by moving piston rod 26 in and out of displacement cylinder 24.

When rotating console 23 about horizontal axle 22 of universal joint 21, use is made of an adjustable displacement cylinder 28 located between a cantilever arm 29 of console 23 and a corresponding cantilever arm 31 of connection piece 18.

Figure 4:
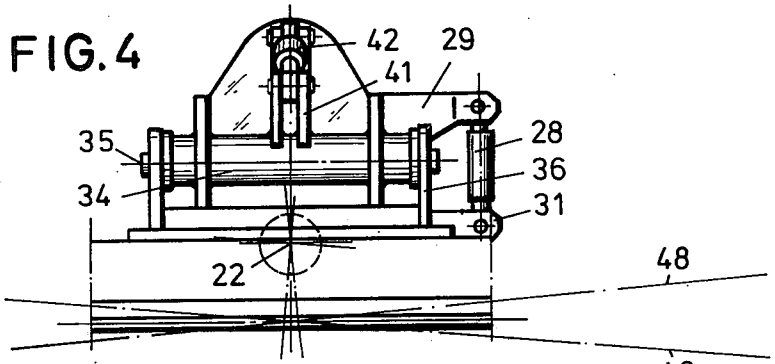
FIG. 4 is an elevation of the front part of the machine tool arm on an enlarged scale.

As best seen in FIGS. 4 and 6, console 23 includes an essentially vertically mounted support plate 32 and a pair of web plates 33 secured to support plate 32, a bearing shell 34 being seated at the free ends of said web plates so that shell 34 may rotate about an axle 35. A carriage 37 carrying a boring tool driven by drive unit 38 is mounted to end plates 36 connected to shell 34. For the mid position of the boring tool, axle 35 extends in a horizontal plane which runs parallel to pivoting axles 13, 14 of machine tool arm 9. Carriage 37 furthermore may be tilted to both sides about axle 35. To that end, an adjustable displacement cylinder 42 is mounted between support plate 32 of console 23 and a flange 41 attached to and extending from bearing shell 34.

Figure 1:
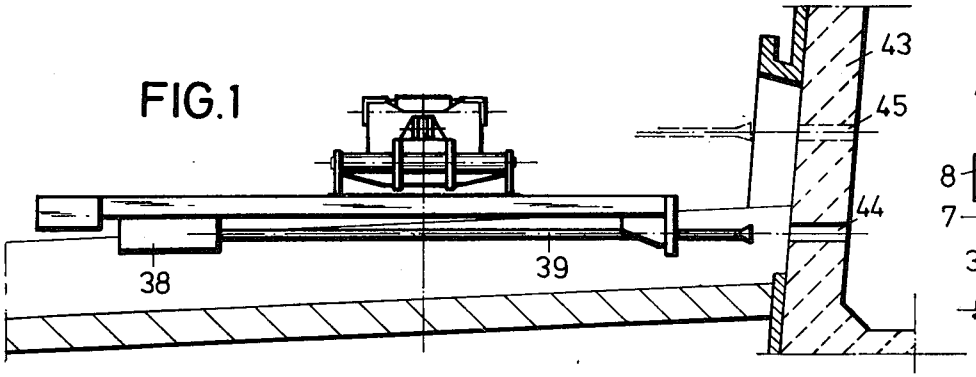
FIG. 1 shows an elevation of the taphole boring machine in its lower boring position.
Figure 2:
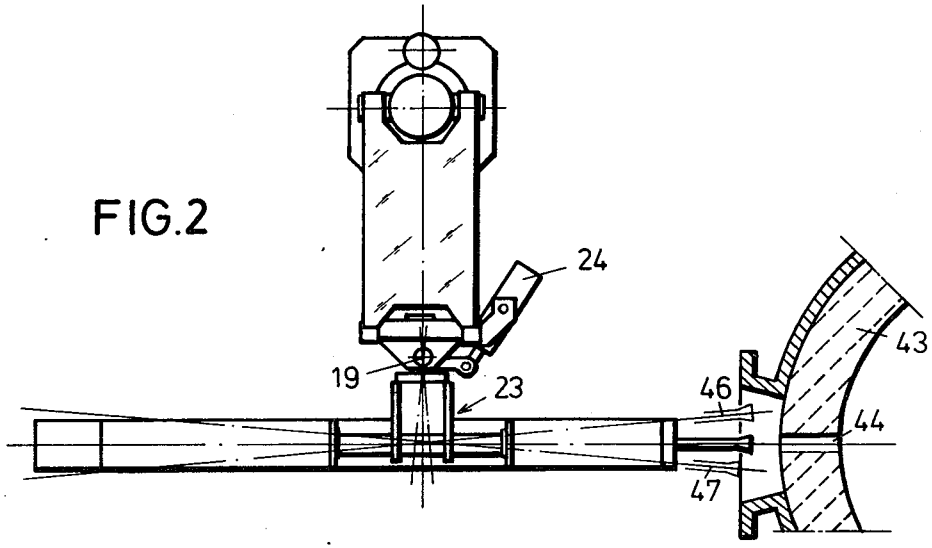
FIG. 2 is a top plan view of the taphole boring machine.

After the taphole boring machine is set, the planned tapholes 44, 45 in the hearth of a shaft furnace 43 may be bored by means of boring tool 39 (FIGS. 1 and 2). The taphole boring machine of the invention allows boring a taphole 44 located at ordinary elevation above the mill floor and also any further tapholes desired on a vertical line up to the appreciably higher one 45, which for instance may be an emergency taphole about 1.5 meters higher than the ordinary taphole 44. Again the taphole boring machine allows drilling not only horizontal tapholes, but also tapholes which are oblique.

In FIG. 1, the taphole boring machine is shown in its lowermost position, and as seen from FIG. 2, the support console 23 may be so adjusted about vertical axle 19 by actuating the displacement cylinder 24 so that boring tool 39 is pivoted between positions 46, 47 shown in phantom lines.

In order to drill a slanted borehole, console 23 and carriage 37 suspended from console 23 are brought into the desired oblique position by being pivoted about horizontal axle 22 by actuation of displacement cylinder 28. Carriage 37 or boring tool 39 may be adjusted as far as positions 48, 49 shown in FIG. 4.

If the higher taphole 45 is to be drilled, then machine tool arm 9 is pivoted into its high position shown by dash-dot lines in FIG. 3 by actuating lifting cylinder 15. When drilling carriage 37 is raised from its lowest drilling position to the highest, the tip of boring tool 39 will describe an arc of a circle. Carriage 37 must be laterally displaced when drilling tapholes which are so much apart, in order to compensate for the deviations from the vertical taphole plane determined by said arc of circle. This is achieved by means of the displacement cylinder 42, which is located between carriage 37 and console 23. Displacement cylinder 42 allows carriage 37 to tilt as far as positions 51, 52 shown in broken lines in FIG. 6.

In lieu of using one carriage, application of the same principle may also be implemented by means of a taphole boring machine with two carriages. Such a machine operates in such a manner that first one boring tool drills the taphole until a residual thickness of wall remains, said residual part being knocked out by means of a battering ram used to operate a plugging gun instead of a taphole boring device, by merely changing the tool.

We claim:

1. A taphole boring or plugging machine for shaft furnaces and especially blast furnaces and particularly those which operate under high pressures, by means of which tapholes may be bored and sealed at various heights of said furnaces and at various angles in said furnaces which comprises:

a console mounted on the mill floor and including a vertical column;

a sleeve supported on said vertical column and pivotable about the vertical axis of said column;

drive means operatively associated with said sleeve for pivoting said sleeve about said column;

a machine tool arm having one end pivotally connected to said sleeve;

a support bracket provided at the other end of the machine tool arm;

a tool holding carriage or sealing gun supported by the support bracket;

wherein said machine tool arm (9) comprises two parallel links, one end of each of said links being connected to said sleeve by means which permit each of said links to pivot about a horizontal axis; and a connecting piece (18) pivotally connected to the other end of each of said parallel links and forming a paralellogram the sides of which consist of said links, said sleeve and said connecting piece; and a universal joint including a vertical axle (19) and a horizontal axle (22) said universal joint being supported by said connecting piece so as to be pivotable about said vertical axle (19), and said universal joint supporting said support bracket so that it is pivotable about said horizontal axle (22), said support bracket consisting of an essentially vertically extending support plate (32) and a pair of essentially horizontal web plates (33) extending from said support plate and a support sleeve (34) between said web plates having a tilting axis (35) and on which are mounted end plates (36) for supporting said tool holding carriage (37).

2. Machine for drilling and sealing tapholes as defined in claim 1 including in addition, a first adjustment cylinder (24) operatively connected to said connection piece (18) and containing a piston rod (26) whereby said support bracket (23) is adjustably supported for pivoting about said vertical axle (19), and a second adjustment cylinder (28) resting on said connection piece (18) and engaging said support bracket (23) and controlling pivoting motion of said support bracket (23) about said horizontal axle (22), and a third adjustment cylinder (42) mounted between said support bracket (23) and a flange eye (41) of said support sleeve (34) for the purpose of pivoting the tool holding carriage (37) or the sealing gun about said tilting axes (35).

* * * * *